US005315947A

United States Patent [19]

Knight

[11] Patent Number: 5,315,947

[45] Date of Patent: May 31, 1994

[54] MULTI-SECTION HULL STRUCTURES

[76] Inventor: Francis Knight, P.O. Box 510, Pineland, Fla. 33945

[21] Appl. No.: 928,329

[22] Filed: Aug. 12, 1992

[51] Int. Cl.[5] ..... B63C 13/00

[52] U.S. Cl. ..... 114/61; 114/123

[58] Field of Search ..... 114/61, 123, 243, 263

[56] References Cited

U.S. PATENT DOCUMENTS

| | | | |
|---|---|---|---|
| 1,355,937 | 10/1920 | Brosnan . | |
| 2,975,747 | 3/1961 | Opie | 114/61 |
| 3,244,134 | 4/1966 | Power . | |
| 3,485,198 | 12/1969 | Matthews | 114/123 |
| 3,828,379 | 8/1974 | Walston | 114/61 |
| 3,871,316 | 3/1975 | Woodrich | 114/61 |
| 3,877,094 | 4/1975 | Kelley | 114/61 |
| 3,883,909 | 5/1975 | Fisher et al. . | |
| 3,887,952 | 6/1975 | Nicoll, Jr. . | |
| 3,968,532 | 7/1976 | Bailey | 114/61 |
| 3,977,344 | 8/1976 | Holford | 114/263 |
| 4,159,006 | 6/1979 | Thurston . | |
| 4,223,621 | 9/1980 | Berger . | |
| 4,337,543 | 7/1982 | Van Ulzen | 114/123 |
| 4,452,166 | 6/1984 | Daniel . | |
| 4,627,372 | 12/1986 | Douglas | 114/61 |
| 4,736,702 | 4/1988 | Gubin . | |
| 4,777,898 | 10/1988 | Faulkner | 114/61 |
| 4,928,619 | 5/1990 | Cochran . | |
| 5,056,448 | 10/1991 | Miller, Sr. . | |

FOREIGN PATENT DOCUMENTS

| | | | |
|---|---|---|---|
| 2562862 | 10/1985 | France | 114/61 |

*Primary Examiner*—David M. Mitchell
*Assistant Examiner*—Stephen P. Avila
*Attorney, Agent, or Firm*—Jacobson, Price, Holman & Stern

[57] ABSTRACT

A water going vessel, which may be a mono hull-type vessel or a multihull-type vessel has a hull which is divided lengthwise into a row or rows of individual hull sections. Each hull section is pivoted along its outer edge to an outer edge of a deck frame of the vessel. The hull sections can be swung upwardly and out of the water individually for inspection and treatment without substantially affecting the buoyancy of the vessel as a whole. The entire hull can be inspected and treated, without having to pull the vessel from the water, by lifting the individual hull sections in sequence.

4 Claims, 4 Drawing Sheets

FIG. 12
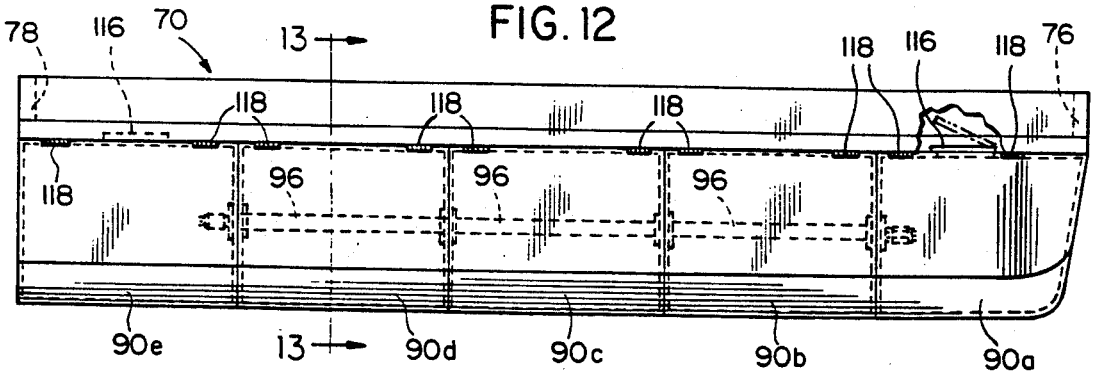
FIG. 13
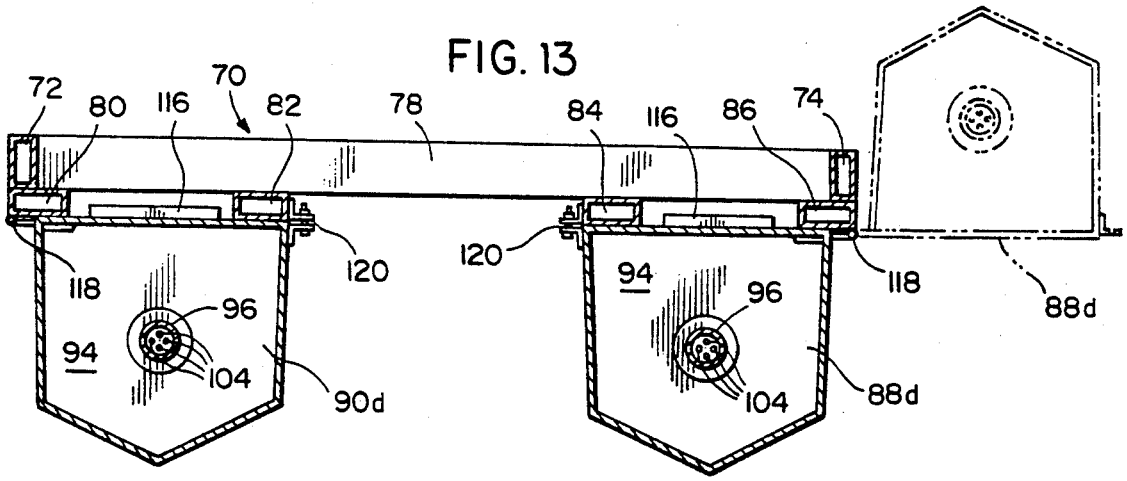
FIG. 14
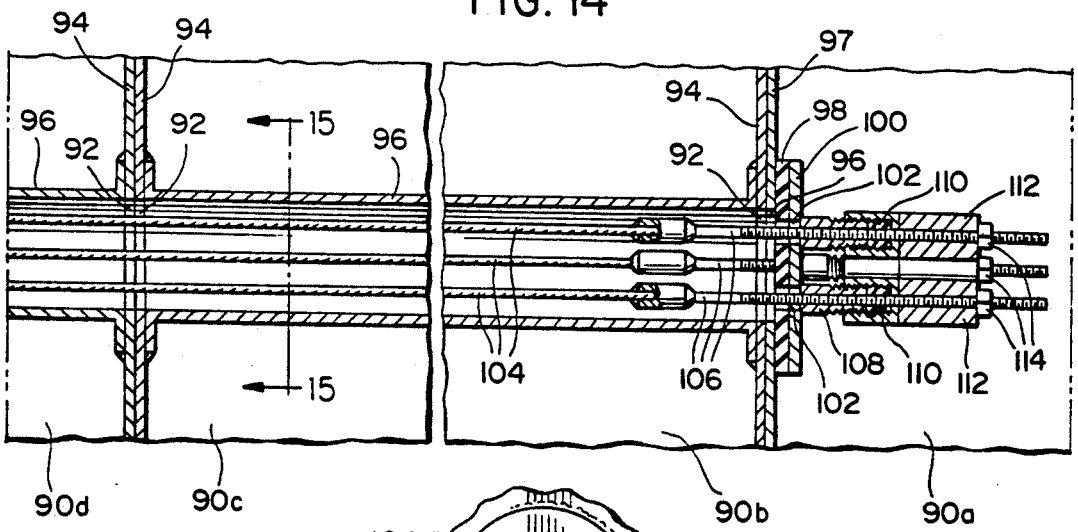
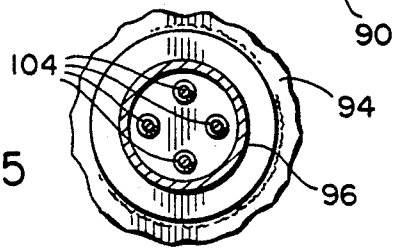
FIG. 15

MULTI-SECTION HULL STRUCTURES

BACKGROUND OF THE INVENTION

This invention relates to multi-section hull structures for water craft ranging from small boats to larger ocean-going vessels.

Except for small trailerable vessels, substantially all boats and ships need to be hauled from the water on a regular basis for inspection and/or treatment of the hull such as scraping repair or painting. This is a generally time-consuming and expensive exercise, which is particularly burdensome to private boat owners.

SUMMARY OF THE INVENTION

It is an object of the invention to provide a water going vessel having a novel form of hull structure which obviates the need for removing the vessel as a whole from the water to inspect and treat the hull.

Another object of the invention is to provide a hull structure for a vessel which has separate sections that can be removed from the water individually for inspection and/or treatment, without substantially affecting the overall buoyancy of the vessel.

In accordance with the invention therefore, a water going vessel includes a deck frame and a hull structure attached to and extending below the deck frame, the hull structure comprising a plurality of individual hull sections located end to end lengthwise of the deck frame, each hull section being pivotally connected along an outer edge portion thereof to an outer edge portion of the deck frame, for swinging the hull section from a water-going position up and out of the water, and the hull structure further having releasable attachment means between inner edge portions of the respective hull sections and inboard portions of the deck frame for securing the hull sections to the deck frame in the water-going position.

With the above arrangement, the hull sections can be swung out of the water individually for inspection and/or treatment, by suitable lifting means, without having to remove the entire vessel from the water and without substantially affecting the buoyancy of the vessel as a whole. The entire hull can thus be treated by lifting the hull sections individually in sequence.

The inventive hull structure is applicable to a wide range of water-going vessels from small boats to larger sea-going vessels and can be used on both mono-hull and multi-hull vessels. In the case of a mono-hull vessel, the individual hull sections may conveniently be arranged in port and starboard rows which, in the water-going position are substantially contiguous along the longitudinal center line of the vessel.

Additional features and advantages of the invention will be apparent from the ensuing description and claims read in conjunction with the attached drawings.

BRIEF DESCRIPTION OF DRAWINGS

FIG. 12 is a side view of a deck frame and hull assembly for an ocean-going catamaran-type vessel according to the invention, FIG. 13 is a sectional view on line 13—13 of FIG. 12.

FIG. 14 is an enlarged sectional elevation showing a stabilizing cable system connected between hull sections of the assembly, and FIG. 15 is a sectional view on line 15—15 of FIG. 14.

DESCRIPTION OF PREFERRED EMBODIMENTS

Referring initially to FIGS. 1–6, there is shown an assembly 10 for a catamaran-type vessel comprising a substantially rectangular deck frame 13 and port and starboard hull structures 14, 16. The deck frame and hull structures may be formed in any conventional boat building material such as wood, fiberglass or metal and typically the deck frame will be covered by a deck and superstructure not shown. The illustrated assembly is suitable for use in both sailing craft and powered vessels.

Figure 1:
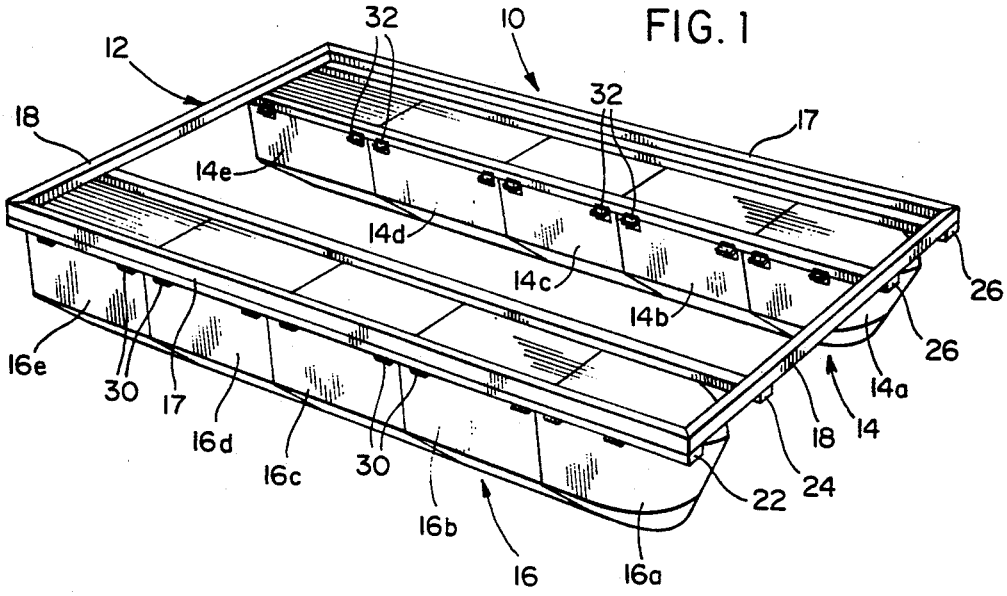
FIG. 1 is a perspective view of a deck frame and hull assembly for a catamaran in accordance with the invention.
Figure 2:
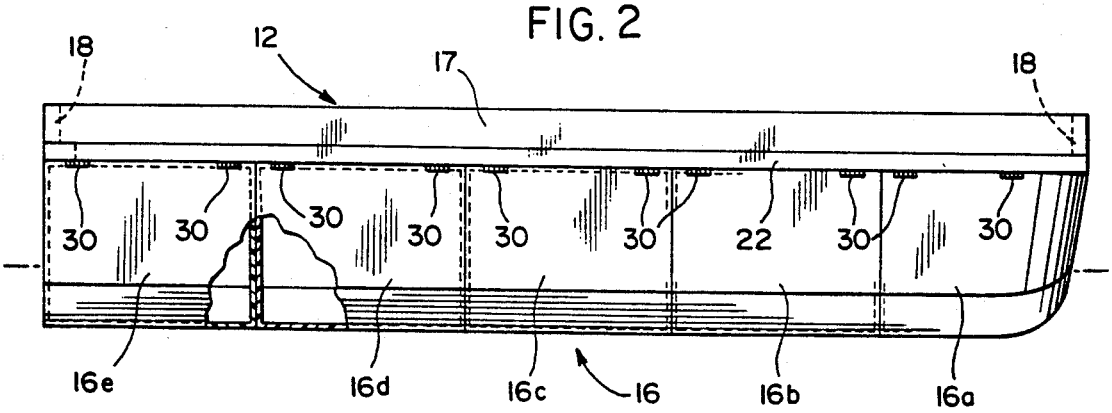
FIG. 2 is a side elevational view, part broken away, of the assembly shown in FIG. 1.
Figure 3:
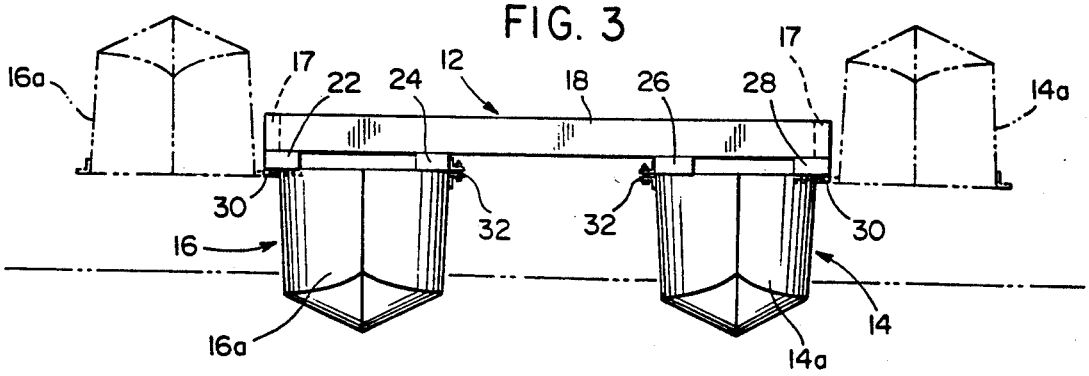
FIG. 3 is an end view of the assembly.
Figure 4:
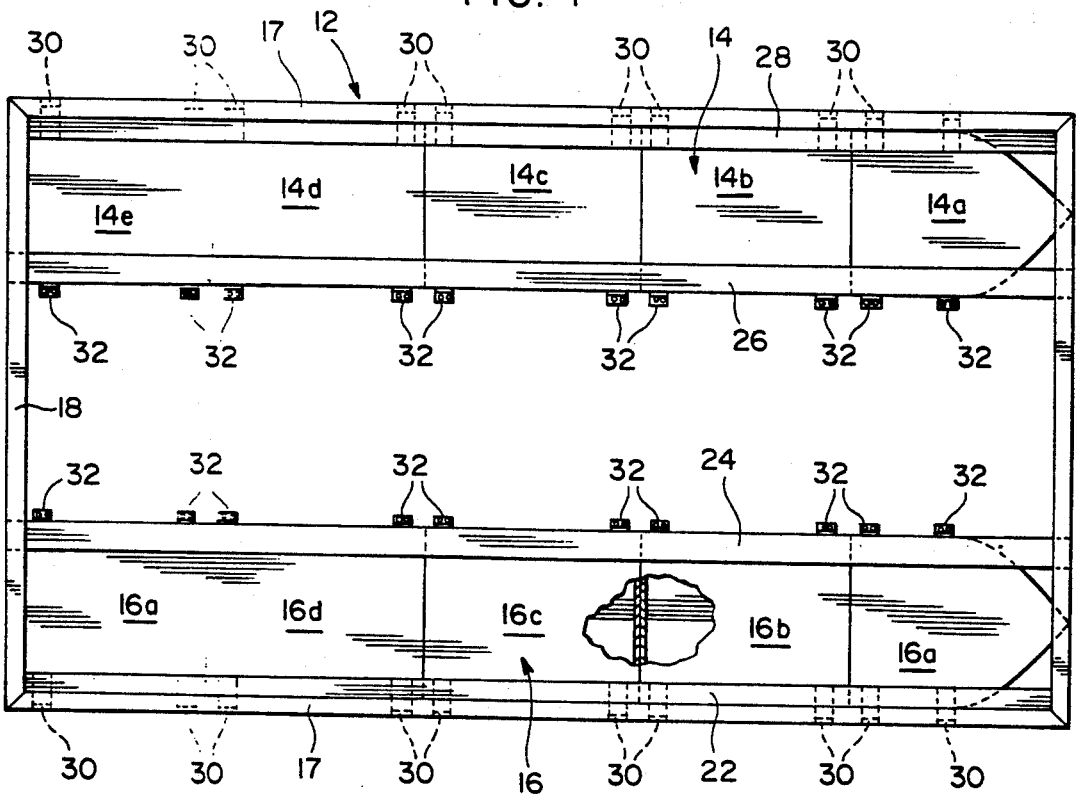
FIG. 4 is a plan view, part broken away, of the assembly.
Figure 5:
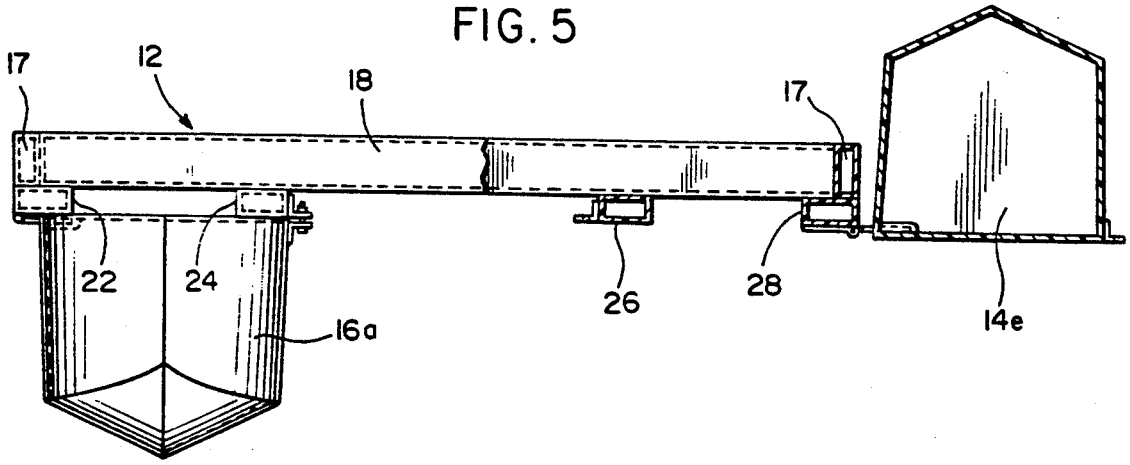
FIG. 5 is an end view of the assembly, partly in section and showing a hull section in an elevated position.
Figure 6:
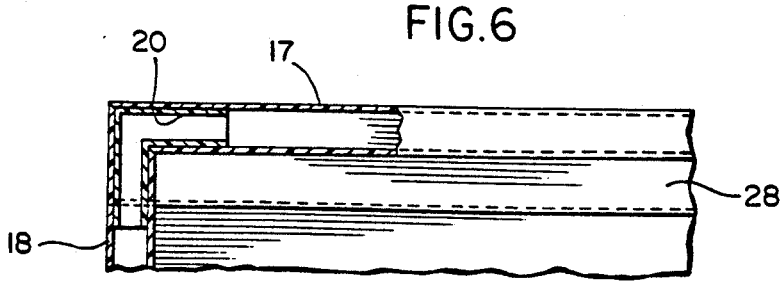
FIG. 6 is an enlarged plan view of a corner detail of the deck frame.
Figure 7:
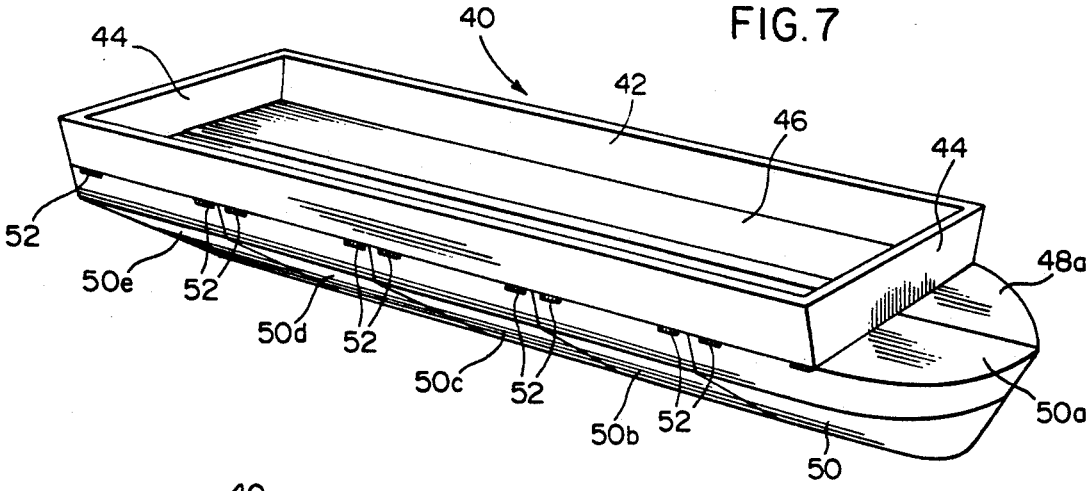
FIG. 7 is a perspective view of a deck frame and hull assembly for a mono-hull vessel according to the invention.
Figure 8:
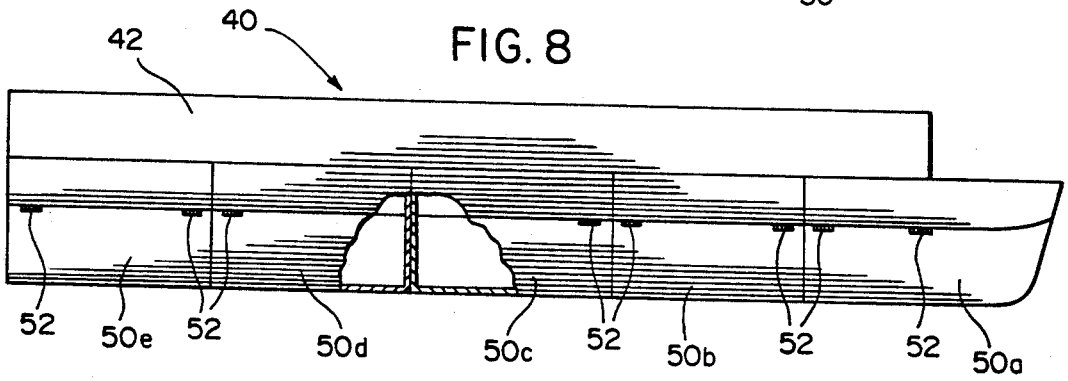
FIG. 8 is a side elevation, part broken away, of the assembly shown in FIG. 7.

The deck frame 12 comprises an upper rectangular framework of box-type longitudinal girders 17 connected to similar fore and aft cross girders 18. The girders may have mitred corners with reinforcing inserts 20 as shown in FIG. 6. The deck frame further comprises lower lengthwise box-type girders 22, 24, 26, 28 welded or otherwise secured to the upper girders.

Each of the hull structures 14 and 16 comprises a row of individual substantially contiguous buoyant hull sections **14*a*–14*e* and 16*a*–16*e* extending fore to aft of the deck frame. The outer edges of the respective hull sections are connected by pairs of hinges 30 to the respective outer girders 22 and 28 of the deck frame and the inner edges of the respective hull sections are releasably connected by pairs of releasable attachments 32 to the respective inner girders 24 and 26 of the deck frame. The attachments 32 may, for example, comprise angle member and bolt connectors or the like. The arrangement is such that by release of the relevant attachments 32, any one of the hull sections can be pivoted upwardly and outwardly from a water-going position of the structure (shown in full line in FIG. 3 and on the left in FIG. 5) to an inspection and treating position (shown in dotted line in FIG. 3 and one the right in FIG. 5**). Thus, the hull sections can be raised individually out of the water for inspection and treatment without substantially affecting the overall buoyancy of the vessel.

As shown in the drawings, the individual hull sections are each of a hollow water-tight construction, but other constructions may also be utilized.

Figure 9:
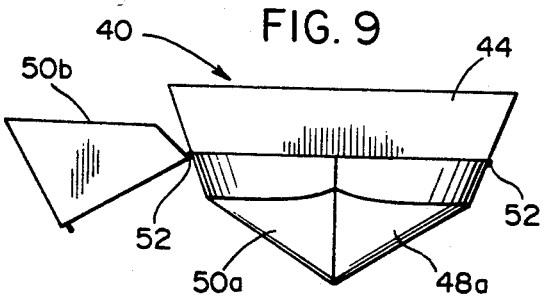
FIG. 9 is an end view of the assembly.
Figure 10:
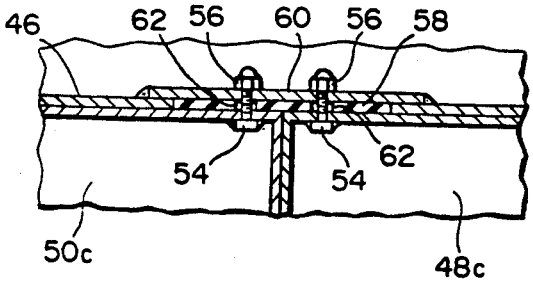
FIG. 10 is an enlarged sectional view showing attachment means between the hull sections and deck frame of the assembly.
Figure 11:
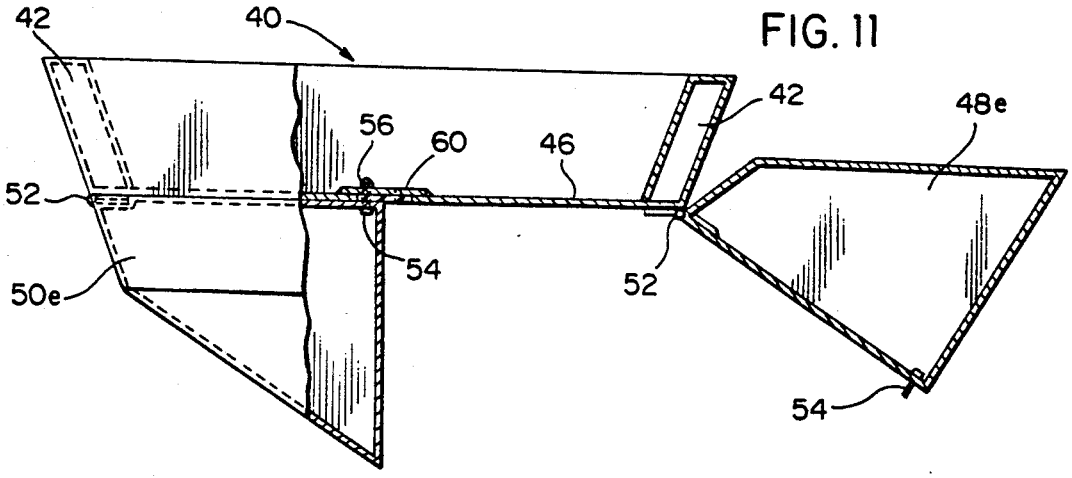
FIG. 11 is an enlarged end view of the assembly showing a hull section in an elevated position.

FIGS. 7 to 11 show a deck frame and hull assembly 40 for a mono-hull type vessel. The deck frame in this embodiment comprises outer lengthwise box-section frame members 42 with connecting fore and aft box section frame members 44 and an integrated base board 46. The hull structure comprises port and starboard rows of individual buoyant hull sections 48*a*–48*e* and 50*a*–50*e*. As in the previous embodiment, outer edges of the respective hull sections are connected by pairs of hinges 52 to the outer frame member 42 and inner edges of the respective hull sections have releasable attachments to inboard portions of the baseboard 46. The attachments may, as shown, comprises bolts 54 welded or otherwise secured to the respective hull sections, which fasten with nuts 56 to the baseboard. As shown in FIG. 10, the baseboard may include a sealing gasket 58 and welded plate 60 with apertures 62 through which the bolts are passed. Again, the assembly may be made of conventional boat building materials. As previously, upon release of the relevant attachments, the respective hull sections can be lifted out of the water individually as shown in FIGS. 9 and 11 for inspection and/or treatment.

FIGS. 12 to 15 show a deck frame and hull assembly 70 for a larger ocean-going catamaran-type vessel having a deck frame similar to that of the first embodiment with an upper framework having longitudinal box-section girders 72 and 74 and fore and aft lateral girders 76 and 78. Again, the deck frame has lower longitudinal box-section girders 80, 82, 84 and 86. The hull structure comprises a port row of individual buoyant hull-sections 88*a*–88*e* and a starboard row of individual buoyant hull sections 90*a*–90*e*. (Only certain of the hull sections are shown in the drawings.) In order to interconnect and stabilize the respective individual sections of each of the port and starboard hull structures when the vessel is under way, each of these structures is provided with a tensionable cable system as will now be described. Reference will be made only to the starboard hull structure but it is understood that the port hull structure has a like system.

The hull sections 90*b*–90*d* have apertures 92 in their respective end plates 94 and flanged tubes 96 are welded inside the hull sections to the opposite end plates around the apertures, so that the water tight nature of the hull sections is maintained. The fore and aft hull sections have aligned apertures 96 in one end plate 97, such apertures being surrounded internally of the respective hull section by a sealing gasket 98 and flange 100 bonded or otherwise secured to the interior of the respective end plate. A plurality of apertures 102 in the flanges and gaskets (four in the illustrated embodiment, but the number can be varied) allows an equivalent number of tensioning cables 104 with end bolts 106 secured thereto to be extended through all of the tubes 96 and fastened and tensioned at each end. To this end, each cable bolt 106 carries a threaded sleeve 10, packing material 110 in a surrounding threaded sleeve 112 and a tensioning nut 114. The arrangement prevents water which may seep between the hull sections from penetrating into the interior of the hull sections.

When the vessel is under way, the cables 104 are tensioned so as to interconnect and stabilize the hull sections. When it is required to raise the hull sections, as in the previous embodiments for inspection and/or treatment, however, the cables can be removed, by removal of the tensioning assemblies at each end. To obtain access to the forward and aft hull sections, for this purpose, each of these hull sections is provided with a hatch 116. For raising and lowering the hull sections, as in the previous embodiments, they are connected to the outer girders 80, 86 by hinges 118 and to the inner girders 82, 84 by releasable attachments 120.

While only preferred embodiments of the invention have been described herein in detail, the invention is not limited thereby and modifications can be made within the scope of the attached claims.

I claim:

1. For a water-going vessel, an assembly comprising a deck frame and a hull structure attached to and extending below the deck frame, the hull structure having a row of individual hull sections located end to end lengthwise of the deck frame, connector means pivotally connecting each hull section along an outer edge portion thereof to an outer edge portion of the deck frame for enabling the hull section to be swung individually and selectively from a water-going position upwardly and out of the water and releasable attachment means for attaching inner edge portions of the respective hull sections to inboard portions of the deck frame in the water-going position, the assembly further including releasable means for releasably interconnecting and stabilizing the hull sections when the vessel is under way, wherein the hull sections include a foreword hull section, an aft hull section and at least one intermediate hull sections, wherein the releasable means comprises at least one cable, a passage means through the intermediate hull section for the cable and fastener means for releasably securing opposite ends of the cable to end walls of the forward and aft hull sections respectively.

2. An assembly as claimed in claim 1, wherein the passage means comprises aligned apertures in opposite end walls of the intermediate hull section, and a tube extending through the intermediate hull section with opposite ends of the tube connected to the respective end walls around said apertures.

3. An assembly as claimed in claim 1, wherein the end walls of the foreword and after hull sections have apertures for passage of the cable and the fastener means include end bolts on the cable, sleeves for engaging over the end bolts around said apertures and tensioning nuts to thread on said bolts and apply tension to the cable.

4. An assembly as claimed in claim 3, including water excluding packing means for preventing water penetrating the forward and aft hull sections around said end bolts.

* * * * *